US010850143B2

(12) United States Patent
Archibald et al.

(10) Patent No.: US 10,850,143 B2
(45) Date of Patent: Dec. 1, 2020

(54) ACTIVATOR OF PILOT TYPE FIRE PROTECTION SYSTEMS AND SYTEMS USING SAME

(71) Applicant: Victaulic Company, Easton, PA (US)

(72) Inventors: Thomas Edwin Archibald, Saunderstown, RI (US); Yoram Ringer, Providence, RI (US)

(73) Assignee: Victaulic Company, Easton, PA (US)

( * ) Notice: Subject to any disclaimer, the term of this patent is extended or adjusted under 35 U.S.C. 154(b) by 111 days.

(21) Appl. No.: 16/047,306

(22) Filed: Jul. 27, 2018

(65) Prior Publication Data

US 2019/0030385 A1 Jan. 31, 2019

Related U.S. Application Data

(60) Provisional application No. 62/538,364, filed on Jul. 28, 2017.

(51) Int. Cl.

| | |
|---|---|
| ***A62C 35/66*** | (2006.01) |
| ***A62C 37/36*** | (2006.01) |
| ***A62C 37/08*** | (2006.01) |
| ***A62C 35/68*** | (2006.01) |

(52) U.S. Cl.

CPC ..... *A62C 35/66* (2013.01); *A62C 35/68* (2013.01); *A62C 37/08* (2013.01); *A62C 37/36* (2013.01)

(58) Field of Classification Search

CPC ..... A62C 35/68; A62C 37/08; A62C 37/36; A62C 35/66

USPC ..... 137/457, 463

See application file for complete search history.

(56) References Cited

U.S. PATENT DOCUMENTS

| | | | | | |
|---|---|---|---|---|---|
| 400,245 | A * | 3/1889 | Neu | G05G 17/00 | 74/2 |
| 904,662 | A * | 11/1908 | Wells | F16K 17/00 | 137/463 |
| 943,559 | A * | 12/1909 | Miller | F16K 17/00 | 137/463 |
| 960,569 | A * | 6/1910 | Moon | F16K 17/00 | 137/458 |

(Continued)

FOREIGN PATENT DOCUMENTS

| | | |
|---|---|---|
| WO | WO 2018/049422 | 3/2018 |
| WO | WO 2018/049427 | 3/2018 |

*Primary Examiner* — Umashankar Venkatesan

(74) *Attorney, Agent, or Firm* — Ballard Spahr LLP

(57) ABSTRACT

An activator for a pilot type firefighting system for accelerating firefighting system activation is disclosed. The system comprises a control valve which acts to control firefighting fluid flow to a distribution system, and configured such that release of pressure to a control chamber would activate the control valve. The activator comprises a first chamber in fluid coupling to the pilot fluid and a second chamber in fluid coupling to the pilot line via a flow restrictor. A pressure sensing member is disposed such that pressure difference between the chambers would cause an activation of a switch. The release of the switch directly or indirectly causes activation of an electrical valve which vents the pressure in the control chamber. Several aspects of the invention include various firefighting arrangements, various optional features of the activator, firefighting system, and several methods of operation of a system utilizing the activator.

15 Claims, 6 Drawing Sheets

Fig. 6

(56) References Cited

U.S. PATENT DOCUMENTS

| | | | | | |
|---|---|---|---|---|---|
| 1,032,052 | A * | 7/1912 | Evans | F16K 17/00 | 137/463 |
| 1,433,416 | A * | 10/1922 | Reed | G05D 16/0663 | 137/463 |
| 1,469,201 | A * | 9/1923 | Whitted | G05D 16/10 | 137/461 |
| 1,566,748 | A * | 12/1925 | Hoult | F16K 17/00 | 137/463 |
| 2,322,960 | A * | 6/1943 | Wright | B60T 15/54 | 303/80 |
| 2,484,940 | A * | 10/1949 | Franzheim | F16K 17/00 | 137/77 |
| 3,589,445 | A * | 6/1971 | Juliano | A62C 35/64 | 169/17 |
| 2012/0031630 | A1 * | 2/2012 | Stephens | A62C 35/62 | 169/17 |
| 2014/0182865 | A1 | 7/2014 | Ringer | | |

* cited by examiner

ACTIVATOR OF PILOT TYPE FIRE PROTECTION SYSTEMS AND SYTEMS USING SAME

TECHNICAL FIELD

The present invention is directed generally to improvements in pilot type fire protection systems, and more particularly to devices, systems, and methods for activating and accelerating the activation thereof.

BACKGROUND

The field of fire protection is of extreme importance to life and equipment. Sprinkler systems are standardized nowadays to deliver the fire suppression fluid to the needed sites. Sprinkler systems comprise a fluid distribution system, having pipes that communicates fluid to a plurality of individual sprinklers. In certain sprinkler systems commonly known as wet systems, fluid, such as water by way of example, is present at the sprinkler. A heat sensitive element holds the water from discharging, and when the heat sensitive element is exposed to a pre-determined temperature the element trips and releases water. However, certain implementations, such as outdoor systems in cold geographical locations, or cold storage facilities by way of example, present freezing risk if the fluid is kept in the distribution system. To resolve this problem many sprinkler systems are dry—the fluid is introduced to the system only in case of detection of fire. Controlling the introduction of the fluid is done by a control valve. Various embodiments of such systems are known, and are commonly known as dry pilot, wet pilot, dry system, deluge, and others.

Firefighting system design presents many challenges to the designer including a need to optimize the effectiveness of the fire protection equipment while at the same time minimizing the cost of installation. Improving fire protection calls for rapid delivery of fire suppression fluid such as water, foam, or gas, to overcome fires. Fires grow rapidly and therefore methods to achieve early fire suppression can significantly reduce overall installation costs by minimizing the scale of the system needed to suppress the fire. Rapid delivery design requirements can drive a need for large pipe and valve diameters, and/or a need for high operating pressures to accelerate fluid delivery. Clearly, high reliability is of-course desired.

Automatic activation of the fire suppression system is desired. To that end hydraulic valves were designed, to controllably transition a control valve from a closed to open state. In a hydraulic valve, fluid pressure is applied to a control chamber, and is applied to a waterway sealing member. Release of the pressure in the control chamber causes the sealing member to open, and allows distribution of the primary firefighting fluid into the firefighting system. A control valve may be utilized for different functions and/or sprinkler systems, such as deluge, wet system, dry, pre-action valves, pressure reducing, deluge reducing and deluge on/off applications. The terms base valve and control valve shall be used interchangeably in these specifications.

The control valve has at least a valve body, an inlet in fluid communication with an inlet chamber which can hold a fluid supply, and an outlet chamber which can controllably receive fluid from the inlet chamber and pass the fluid to an outlet. The fluid in the input will be referred to herein as a 'primary' fluid. A hydraulic control valve may be in a "closed", (equivalently known as "standby") state where the valve sealing member impedes flow of fluid between the inlet and outlet, and an "opened", (equivalently known as "activated") state in which fluid communication is established between the input and output chambers, and fluid is allowed to flow between the input and the output. The control valve trim comprises external connections and accessory equipment including in certain systems an activation device that when activated releases the pressure in the control chamber causing the sealing member to open, in effect transitioning the control valve from the closed to open state and releasing the primary fluid from the inlet to the outlet. From the valve outlet, piping known as the 'distribution system' then distributes fluid to effect fire suppression.

Yet another control valve commonly utilized in firefighting systems is known as a 'differential dry valve'. In such valve pressure in the distribution system acts directly on one side of a sealing member colloquially known as a 'clapper', the pressure acts against the pressure of the fire suppressant fluid supply. Oftentimes systems and valves are configured such that during activation of the differential dry valve, pressurized pilot fluid is directed to an intermediate chamber which exerts an opening force on the clapper. The pilot induced opening force adds to the opening force of the incoming fire suppressant fluid and accelerates the opening of the control valve. For brevity, the present specifications would describe primarily a firefighting system using a hydraulic control valve, but the skilled in the art would recognize that similar actions may be utilized for releasing pressure in the control chamber of a hydraulic valve as the action of directing the pilot fluid to the intermediate chamber, and the modification in piping would be clear to the skilled person.

Various methods are employed for automatic activation of the fire suppression system. The speed of activation of the control valve is critical for achieving efficient control of a fire. Slow activation of a control valve or trim devices related to such opening can result in increased fire damages, or even failure to control a fire.

A hydraulically controlled valve actuator, is a type of activation device that is subject to pressure from a pressurized fire sensing line that is located in the area to be protected, and is commonly referred to as the 'pilot line'. The term 'line' in this context refers to a length of pipe or pipes, and/or other fluid conduits. The hydraulically controlled valve actuator is colloquially known as a pilot actuator, a dry pilot actuator, a quick opening device and by other names, shall be generally referred to in these specifications as a 'pilot actuator' or equivalently merely as an 'actuator'. The actuator operates on a force differential between the force applied by pilot fluid and the force applied by the control fluid in communication with the control chamber of the control valve.

FIG. 1 depicts a simplified schematic of an exemplary dry pilot sprinkler system common in the art. Primary fire suppression fluid is provided under pressure Pw to a main pipe 2. By way of example such fluid may be from public water supply, a dedicated reservoir, a dedicated firefighting water supply, a gaseous fluid, foam system and the like. The fluid is piped to a shutoff valve 5 which is normally open except during maintenance, testing, or in clearing the system after an activation. A control valve 10 is coupled to the fluid supply downstream from the shutoff valve 5. A fluid distribution system 15 is coupled to the outlet of control valve 10, the fluid distribution system is fluid-wise coupled to a plurality of sprinklers or nozzles 56, for spraying the primary fluid on a fire. Commonly fluid under pressure is also supplied to the control chamber 30 of control valve 10, as well as to control line 20, via flow restrictor 25. It is common to couple fluid from the primary fluid supply to the control valve control chamber 30 as such arrangement simplifies the installation and mitigates pressure fluctuations. However the pressure supplied to the control chamber Pc may come from any desired source, and does not have to come from the primary fluid supply side of the firefighting system. The shutoff valve 5 is commonly required by applicable standards, but may be omitted in certain systems, for example systems which incorporate the shutoff valve in the control valve.

The pressurized fluid supplied to the control chamber 30 maintains the control valve 10 in closed state. A pilot actuator 35 is coupled to the control line 20. The pilot actuator 35 is also coupled to a pilot line 45 which extends to the area to be protected, and which has at least one sensor 55 coupled thereto. Pilot line 45 is pressurized at pilot pressure Pp, and is commonly kept pressurized by a pressure source 50 such as gas or fluid supply, a compressor, and the like, capable of initially pressurizing the line and then compensate for pressure loses. Optionally the pressure source is coupled to the pilot line as required. At least one sensor 55 is constructed to vent the pressure from the pilot line upon at least one condition that is considered to be caused by a fire, such as heat. When sensing a fire, the sensor vents the pilot line at a higher rate than the rate that the pressure source 50 may replenish the pressure, if such source is connected. The sensor may be a sprinkler, electrically operated device such as a solenoid valve, and the like. Oftentimes the main distribution line 15 is used, in whole or in part, as a pilot line 45, or, stated differently, in such systems the pilot line 45 and the distribution system 15 are at least partially integrated.

Upon loss of pilot line pressure Pp, the pilot actuator 35 transitions to an open state, and provides a discharge fluid path which vents the control pressure Pc in the vent line 20, e.g. to the atmosphere, such as via outlet 40. When fully open, the pilot actuator provides a less restrictive fluid path than the fluid path provided via the flow restrictor 25. As the rate of discharge of the pilot actuator is larger than the rate of replenishment via the flow restrictor 25, the pressure Pc in the control chamber 30 is reduced, and control valve 10 is opened.

The system time for opening the pilot actuator may be approximated by $$Ta=(Pp-Pt)/Dp$$

where Ta is the time to activate the pilot actuator from detection of the a fire to beginning of venting pressure Pc from the control line 20, Pp is the pressure in the pilot line, and Pt is the pilot pressure at which the pilot actuator transitions to trip state. Dp is the pressure decay rate in the pilot line.

Decisive and fast opening of the control valve is desired for efficient fire suppression, and furthermore, in certain types of valves, repeated partial opening and closing of the control valve may cause a malfunction of the valve.

In certain firefighting systems, primarily systems which use a compressible pilot fluid such as gas, a device colloquially known as an accelerator valve 60 may also be connected to the pilot line. An accelerator controllably opens an additional discharge path to vent the pilot line 45, therefore increasing the decay rate Dp, and thus decreasing the response time Ta of pilot actuator 35, and thereby the opening time of the control valve 10. Generally, an accelerator valve responds faster to the drop in pilot pressure than the pilot actuator.

An accelerator valve 60 generally has an accelerator seal which is disposed to seal pilot fluid from an accelerator outlet. The accelerator seal is coupled to a differential pressure sensing member, the differential pressure sensing member is exposed on one side to the pilot pressure, and on the opposite side to a pressure in a chamber termed 'delay chamber' in these specifications. The delay chamber is coupled to the pilot line pressure via a flow restrictor which allows flow from the pilot line to the delay chamber. Oftentimes the flow restrictor is simply an orifice, but other embodiments exist, such as a check valve by way of example. As pressure in the pilot line is held steady, both sides of the differential pressure sensing member are substantially exposed to the pilot pressure and the accelerator seal is held closed. If pilot pressure Pp drops, the pressure in the delay chamber drops at a slower rate as fluid in the delay chamber must pass through the restrictor orifice or check valve. The differential pressure sensing member responds to the pressure difference by opening the accelerator seal, which allows pilot fluid to vent. The accelerator 60 increases the rate of pilot fluid release, contributing to faster firefighting system activation.

Pilot actuators are well known in the art. By way of example US Patent Publication No. 20140182865 to Ringer discloses a high liquid to gas trip ratio pilot actuator. Several models of pilot actuator exist, such as by way of example the Model A manufactured by the Reliable Automatic Sprinkler Co., Inc. of Elmsford N.Y., U.S.A., model H-11 is supplied by HD Fire Protect PVT. LTD. Of Thane, India, and the Tyco (Lansdale Pa., U.S.A.) model DP-1 are but few examples. Conceptually, pilot actuator are divided into two main category, namely direct acting and indirect acting.

Pilot accelerators are also well known in the art. By way of example the present applicant Globe Fire Sprinkler Corporation (Standish, Mich., USA) Model C accelerator, Reliable Automatic Sprinkler Co. (Elmsford, N.Y., USA) Model B 1, and others. U.S. Patent Applications No. 62/393,584 (published as WO 2018/049422) and U.S. 62/393,550 (published as WO 2018/049427) to Archibald describe actuator arrangements, and are incorporated herein by reference in their entirety.

A common disadvantage of pilot actuators is caused by their dependence on pressure difference between the pilot pressure Pp and the control pressure Pc, since commonly large volume of the pilot system must be vented via a relatively small outlet. In contrast, the accelerator offers easily controlled sensitivity for providing a faster triggering operation, however while accelerators increase the venting speed of the pilot line the pressure must drop sufficiently to cause activation of the actuator.

Commonly, an activation of the fire fighting system is accompanied by several other activities, such as alarm activation, and the like. oftentimes such systems are electrically operated. To provide such electrical functions during a power outage an electrical backup energy source is commonly provided.

It is seen that the design of a fire suppression system presents a complex compromise between the requirements of high reliability, fast activation, avoidance of nuisance activation, and reducing costs and complexity. Various organizations invest significant efforts and resources into such optimization. There is therefore an ongoing need for optimizing the design of a firefighting system control arrangements, and of trim devices such as pilot actuators and accelerators in fire suppression systems, to provide faster activation, reduced drip/trip interval, and reduce dependency on pressure fluctuations in the control and pilot fluids.

There is also a heretofore unresolved need for an accelerator valve which may reliably assist in fast activation of the firefighting control valve, and/or otherwise activate components of the firefighting systems such as alarms, pumps, and the like. There is further an unresolved need for accelerator valves and other devices and arrangements to increase the speed of firefighting systems activation.

SUMMARY

It is therefore a goal of the present invention to provide an arrangement of trim devices and connections to a firefighting system control valve that would accelerate the activation of the firefighting system.

It is yet another goal of the invention to provide an activator device to act as an accelerator for prompt direct or indirect activation of a control valve in a firefighting system.

To that end, in an aspect of the invention, there is provided an electromechanical firefighting system activator comprising a body defining an inner cavity, the body having a pressure sensing member at least partially disposed within the cavity, the pressure sensing member diving the cavity into a first and second chambers, a pilot fluid port being in fluid communications with the first chamber, at least a portion of the pressure sensing member being movable from a closed to an open state, responsive to pressure difference in the first and second chambers. A fluid flow restrictor disposed in a fluid path providing fluid coupling between the first and second chambers, the restrictor control flow between the chambers and has a smaller flow rate than the flow rate enabled by the pilot fluid port. A switch is disposed to be actuated by the pressure sensing member responsive to the state of the pressure sensing member. The switch may activated by a switch actuation mechanism.

Generally, the pressure sensing member, and thus the activator, is moved to an open state when the pressure in the first chamber is lower than the pressure in the scone chamber. The first chamber is equivalently related to elsewhere in these specifications as the immediate chamber and the second chamber as the delay chamber.

In some embodiments a latch is configured to directly or indirectly capture and maintain the pressure sensing member in the open state, after the pressure sensing member transitioned to the open state. Thus the activator is prevented from resetting the switch if the pressure in the chambers change, once the activator is activated. In other embodiments the switch is latched into activated state once the pressure sensing member has activated it, and the switch remains in the activated state until it is positively reset, such as by manual, electrical, hydraulic reset, and the like. In certain embodiments the switch activates an electrical, electromechanical, or electronic latch, to maintain the firefighting system activated and the actual state of the switch and/or the pressure sensing member becomes immaterial after the initial activation. In certain embodiments the switch latch is operationally separable from the pressure sensing member, such that the pressure sensing member, and/or any intervening part, may be separable from a latch maintaining the switch in activated state, after the activator urged the latch onto the switch. Further alternatively, the activator pressure sensing member may push a latch holding the switch in one state during standby state, away from the switch, allowing the switch to move to an activated state.

It is noted that the activator is responsive to pressure difference between the first and second chambers, formed since the flow restrictor has a known flow rate and thus pressure equalization between the first and second chamber requires a given time proportional to the volume of the second chamber and inversely proportional to the flow rate via the flow restrictor.

In certain embodiments the pressure sensing member is a diaphragm.

Optionally the activator further comprises a rod coupled to the pressure sensing member, wherein the actuation of the switch is affected by the rod. In some embodiments the latch captures the pressure sensing member by the rod, and in certain embodiment the rod serves both for being captured by the latch to maintain the activator in the open state, and to activate the switch. In some embodiments the pressure sensing member is directly coupled to the membrane without a rod.

It is noted that the latch is optional and certain embodiments utilize other latching arrangements. By way of example a hydraulic latch may be utilized, in others latching is achieved via mechanical device within a valve, and the like. In some embodiments, the invention comprises a switch latch which the pressure sensing element urges to hold the switch in an activated position regardless of the state in which the pressure sensing member is disposed. The switch may comprise a magnetic or optical sensor, or a mechanical switch with or without latching.

In certain embodiments the activator further comprises a sealing port in fluid communications with the first chamber, and a seal coupled to the pressure sensing member. The seal impedes fluid flow via the sealing port when the pressure sensing member is in a closed state and allowing fluid communications via the sealing port when the pressure sensing member is in the open state. Thus the seal allows venting the first chamber to the ambient when the activator is open.

In certain embodiments the flow restrictor is at least partially disposed within the pressure sensing member, and optionally extends upwardly into the second chamber. Further optionally, the activator has an orifice seal such as a plug disposed to block fluid flow between the first chamber to the second chamber when the pressure sensing member is in the open state. The plug prevents contamination of the flow restrictor, and also may operate to slow or prevent pressure equalization between the immediate and delay chambers. In certain embodiments the flow restrictor comprises a check valve allowing flow only from the first to the second chamber. Optionally the valve is made intentionally leaky, such that fluid flow is less restricted from the immediate to the delay chamber than fluid flow from the delay to the immediate chamber. However the restrictor may be implemented in other manner. By way of example, the flow restrictor may be disposed in the body or externally thereto.

In an aspect of the invention there is provided a firefighting system arrangement, the firefighting system having a standby state and an activated state, the firefighting system comprising a firefighting fluid distribution system; a pressurized pilot line having at least one fire sensor coupled thereto the sensor being operative to release pressure in the pilot line upon detection of fire; a control valve coupled to the distribution system and operational to control fluid flow from a fluid supply to the distribution system when the system is in activated state, the control valve having a control chamber, the valve being capable of transitioning from a closed state when the system is in standby state to an open state upon release of pressure in the control chamber; and an electromechanical firefighting system activator configured to activate a switch in response to pressure drop in the pilot line. An electrically activated valve is disposed to release pressure from the control chamber of the control valve in response to activation of the switch. The activator may be any of the activator embodiments described above.

BRIEF DESCRIPTION OF THE DRAWINGS

The summary above, and the following detailed description will be better understood in view of the enclosed drawings which depict details of preferred embodiments. It should however be noted that the invention is not limited to the precise arrangement shown in the drawings and that the drawings are provided merely as examples to facilitate understanding of different aspects of the invention.

DETAILED DESCRIPTION OF EXAMPLE EMBODIMENTS

Figure 5:
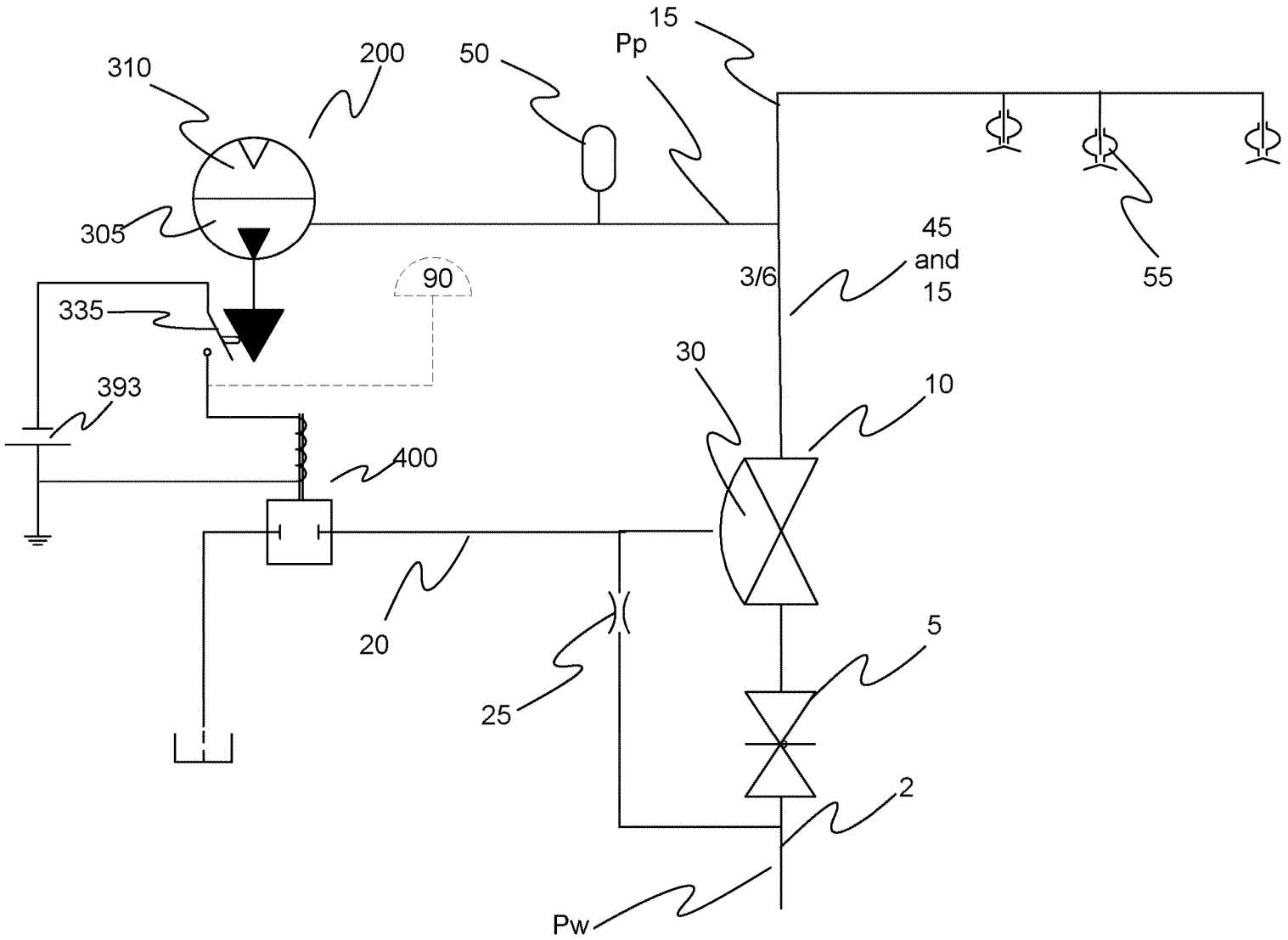
FIG. 5 depicts schematically a pilot type firefighting system embodying an aspect of the present invention.
Figure 6:
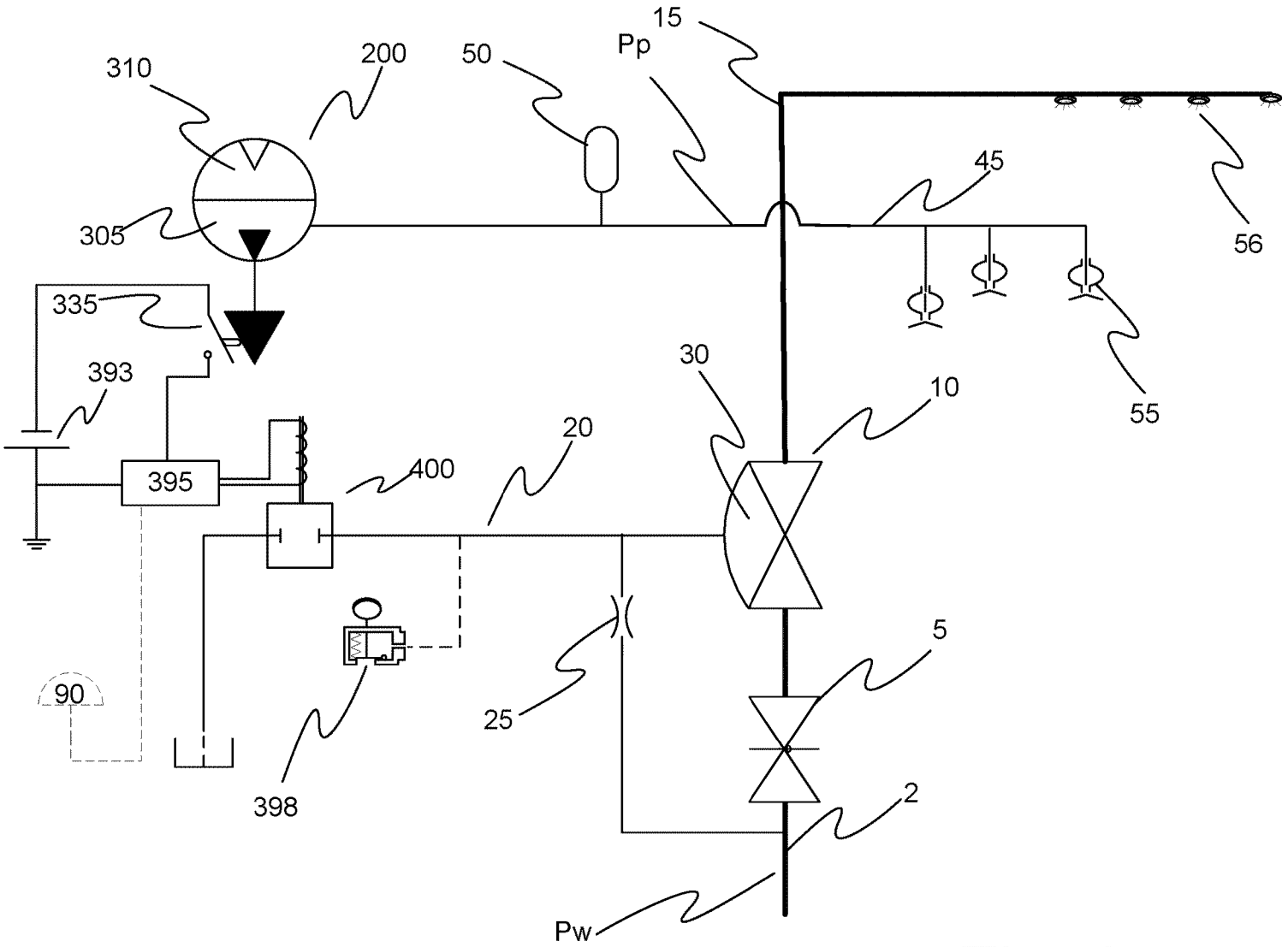
FIG. 6 depicts schematically yet another pilot type firefighting system embodying an aspect of the present invention.

Aspects of the activator is explained in the context of a firefighting system. By way of example FIGS. 5 and 6 depict schematically simplified firefighting system arrangements incorporating an activator 200.

Figure 2:
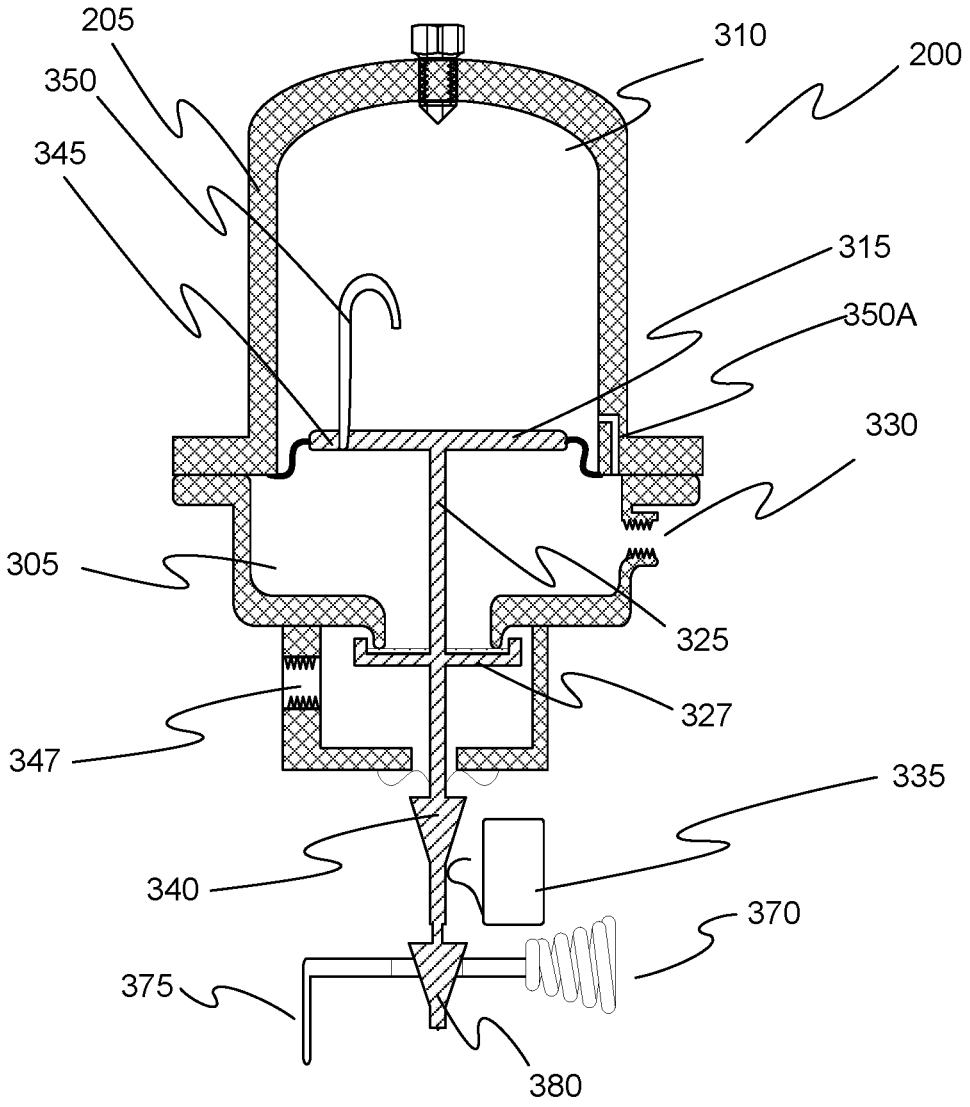
FIG. 2 depicts schematically a cross-section of a firefighting system activator shown in a closed state.

FIG. 2 depicts schematically, a cross-section of a firefighting system activator in accordance with an aspect of the present invention.

Pilot line 45 is coupled to the activator 200 via pilot port 330.

Figure 3:
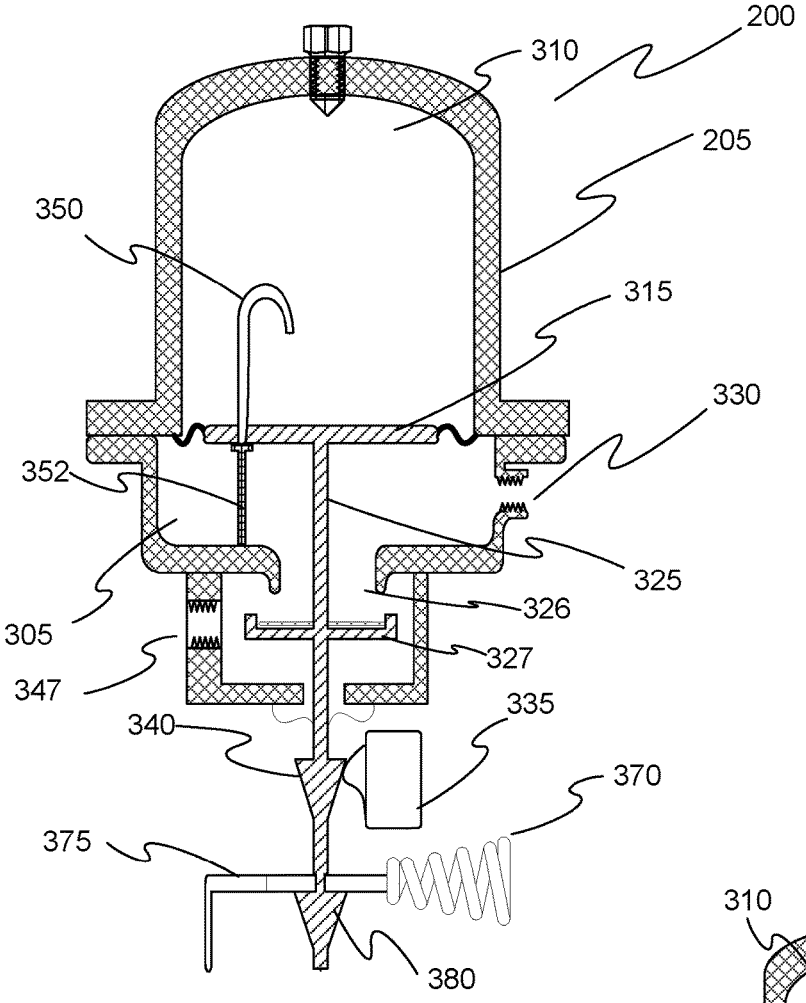
FIG. 3 schematically a cross-section of the firefighting system activator of FIG. 2 shown in an open state.

The activator 200 comprises a body 205 defining a chamber divided into a first and a second chambers, termed an immediate chamber 305 and delay chamber 310. The immediate and delay chambers are mutually separated by a pressure sensing member such as a diaphragm 315. The pressure sensing member 315 is exposed on one side to pressure in the immediate chamber 305, and on the opposite side to pressure in the delay chamber 310. The pressure sensing member 315 is configured to be movable between at least a closed and an opened state. FIG. 2 depicts the pressure sensing member 315 in a closed state, while FIG. 3 depicts it in one of the plurality of potential open states.

The immediate 305 and the delay 310 chambers are in fluid coupling via a flow restrictor 345. When the firefighting system is in standby state the immediate 305 and delay 310 chamber are subject to the same pressure as the pressure has been equalized via the flow restrictor. When changes in the pilot pressure occur slowly, over extended periods of time the pressure is equalized via the flow restrictor. At standby state the pressure sensing member 315 is urged to the closed state by static forces, such as the resilient shape of a diaphragm embodying the pressure sensing member, a spring, differing areas exposed to the pressure in both chambers, and the like. However, when the pressure in the pilot line 45 is reduced the pressure in the immediate chamber 305 is reduced at a faster rate than the pressure in the delay chamber 310, due to the limited flow which is allowed by the flow restrictor 345. Thus a pressure difference is formed between the immediate chamber and the delay chamber, and the pressure sensing member is urged to an open state.

A switch 335 is disposed such a transition of the pressure sensing member from the closed state to an open state urge the switch to activate. The switch may be a normally open or normally closed type, and in certain cases may be magnetic, resistive or capacitive, and the like, however the switch has at least two states, one which is recognized as standby state and the other as activated state, wherein while the switch is in the activated state electrical circuitry would cause activation of the control valve 10, where otherwise the switch is in a standby state. Stated differently, the switch 335 is activated by the transition of the pressure sensing member 315 to an open state, and any state which does not causes such activation of the control valve is considered to be a standby state. The switch may be activated directly or indirectly by the pressure sensing member. FIGS. 2-3 depict embodiments where the switch is activated by a rod 325 coupled to the pressure sensing member 315. In some embodiments the rod has an expanded section 340 which activates the switch 335. As may be seen in FIG. 3, the expanded section pushes an activation arm of the switch. The rod 325 and the expanded section 340 act as a switch activation mechanism. It is noted that other switch activation mechanisms may be utilized, including optional varying mechanical linkages which may be utilized to activate the switch 335 in response to the state of the pressure sensing member. In certain embodiments the pressure sensing member itself acts as the switch actuation mechanism, and the switch is coupled directly thereto. In such embodiments the pressure sensing member or the portion thereof that activates the switch should be construed to embed therein the switch actuating mechanism.

Furthermore, the switch may be implemented in a variety of manners. By way of example the switch may be magnetic such as a reed switch, or a magnetically responsive sensor or contact. The switch may also be capacitive, ultrasonic, optical and the like, as will be clear to the person skilled in the art.

In certain embodiments flow restrictor 345 is implemented as an orifice in the pressure sensing member 315. In other embodiments, as shown by way of example in FIG. 4C, the flow restrictor 345 is external to the activator 200, and in certain other embodiments the flow restrictor is embodied in a passage within the body 205 as shown for example in FIG. 2, enumerated as 350A. One or more flow restrictor passages may be utilized, and the passages may differ in type and/or location. The skilled in the art would recognize many arrangements that would enable a restricted fluid communications from the delay and immediate chambers.

FIG. 3 depict an embodiment in which the flow restrictor 345 comprises an elongated narrow tube 350 extending upwardly into the delay chamber, and in some such embodiments the tube is bent at its upper portion. Such arrangement enhances the reliability of the activator as it reduces the risk of clogged flow restrictor. In certain embodiments which use the tube, the tube itself may act as a flow restrictor, or an orifice may be disposed at its opening or along its length. In certain embodiments, such as shown by way of example in FIGS. 4A and 4B, a check valve 350B allows fluid communication from the immediate chamber to the delay chamber, while impeding or blocking fluid communication from the intermediate chamber to the delay chamber. The check valve may be disposed at any convenient location where it may affect its function.

Certain embodiments provide the immediate chamber with a sealing port 326. In standby state seal 327 seals the sealing port 326 and isolates the immediate chamber 305 from the optional activator output port 347. While the activator is in an activated state, seal 327 is displaced and allows pilot fluid to flow from pilot port 330 to the activator output port 347 via the sealing port 326.

During system standby state, the pressure in the delay chamber 310 substantially equals the pressure in the immediate chamber 305, which in turn equals the pilot pressure Pp. A sensor 55 such as a sprinkler is coupled to the pilot line 45 and is operative to vent the pilot line when activated in response to fire or excessive heat detection. Venting the pilot line causes a drop in the pilot pressure. Thus the pressure in the immediate chamber 305 drops as well. However due to the flow restrictor 350, the pressure in the delay chamber stays at or close to the pilot pressure Pp before the sensor activation for a certain time period. Thus the pressure at the delay chamber urges the pressure sensing member 315 to an open state which moves the seal 327 to permit flow of pilot fluid from the activator pilot port 335 to the accelerator output port 347. Output port may simply be the sealing port which vents directly to the ambient environment, or may be embodied as a separate port, allowing controlled connection thereto. The transition of pressure sensing member 315 to the open state brings the activator to an activated, i.e. open, state. It is noted that if a pressure source 50 is coupled to the pilot line and is operative, the sensor 55 is dimensioned to vent pressure from the pilot line at greater rate than the rate at which the pressure source would replenish it.

FIG. 2 depicts an activator at standby state, while FIG. 3 depicts an activator at an activated state. As rod 325 is coupled to the pressure sensing member 315, it moves downward when the latter transitions to an open state. The expanded section 340 of the rod 325 is pushed against the switch 335 causing the switch to transition to an activated state.

Operationally, activation of the switch is presumed to be due to detection of a fire event, and thus it is desired to maintain the switch activated, until intentionally reset. To that end an optional switching latch is provided. Certain embodiments utilize electrical or electromechanical latching, such as a flip-flop, a relay, electronic latching.

FIGS. 2 and 3 depict a mechanical latching arrangement where the rod has a latching expanded section 380. A latch 375 is urged against the rod 325 or its expanded section by spring 370. The latch has a hole cut thereto, which is sufficiently large to allow the latching expanded section therethrough. Once the rod is pushed downward during the transition of the activator to an activated state, the latch 375 is urged by spring 370 to a locked position, i.e. to the left in the depicted drawing. When in the locked position it holds the latching expanded section 380 against moving back up, thus maintaining the switch in the activated position. Pushing the latch 375 against the spring would allow the rod to move up, allowing the pressure sensing member into the closed state, and such upward movement would release the switch 335.

Notably similar latching results may be obtained by a narrowing in the rod, and the like, as will be clear to the skilled in the art.

Other switching latches may be utilized alone or in combination. By way of example, an electrical solenoid or relay may hold the switch or a secondary switch. An electronic circuit may such as a flip-flop, other logic, or sample and hold circuits may be utilized to provide a switching latch. An electromechanical mechanism may be utilized to activate a mechanical latch. A magnetic device may be utilized to hold the switch activated once it was activated, and the like. In certain embodiments the latching mechanism is separate from the actuator, such as by way of example when logic is utilized at a control panel to affect the latching. Other latching arrangements are envisioned, such as hydraulic latching of the actuator or other firefighting components. By way of example a control valve may be arranged in a latching arrangement, wherein once activated it will maintain the activated state until deliberately reset.

FIG. 3 depicts an optional orifice seal 352. In order to reduce the risk of a clogged flow restrictor 345 and to provide better immunity to pressure fluctuations after activation, an orifice seal or plug may be utilized. The orifice seal 352 is disposed such that when the pressure sensing member 315 is in the activated state the orifice seal prevents or further limits fluid flow between the immediate and delay chambers. Such arrangement would tend to act somewhat similar to a latch, and provide protection to the flow restrictor 345. It is noted that with proper design, the higher the pressure difference between the immediate and delay chamber, the tighter the seal would tend to block fluid flow therebetween. The skilled in the art would recognize that the orifice latch may be embodied in many other forms than the simplified schematic form depicted.

Figure 4A:
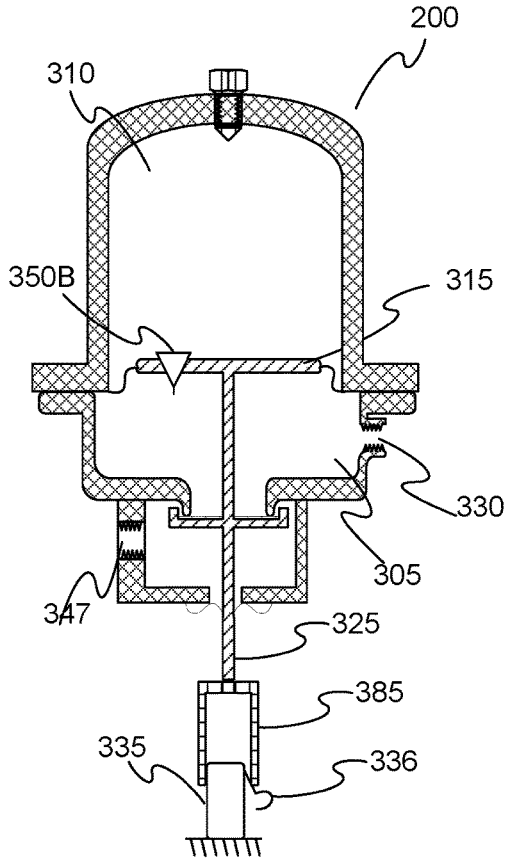
FIGS. 4A-E depict schematically several optional features of the activator.

FIG. 4A depicts yet another embodiment of the activator, showing two optional features which differ from the embodiments of FIGS. 2 and 3. The first difference is the inclusion of a check valve 350B, which allows pilot fluid to flow from the immediate chamber 305 to the delay chamber but impedes the pilot fluid in the delay chamber from flowing back to the immediate chamber. The check valve acts as the flow restrictor 345 or the passage 350A in other embodiments. It is generally desired that such check valve would be made intentionally to leak, thus presenting a high flow resistance to backflow of fluid from the delay to the intermediate chamber. As the pressure in the pilot changes due to temperature, minor leaks, and the like, a check valve which completely seal the backflow would cause trapping of the highest pressure experienced in the system at the delay chamber, which may result in false activation when the pressure in the immediate chamber drops slowly due to such reasons as described above.

Figure 4C:
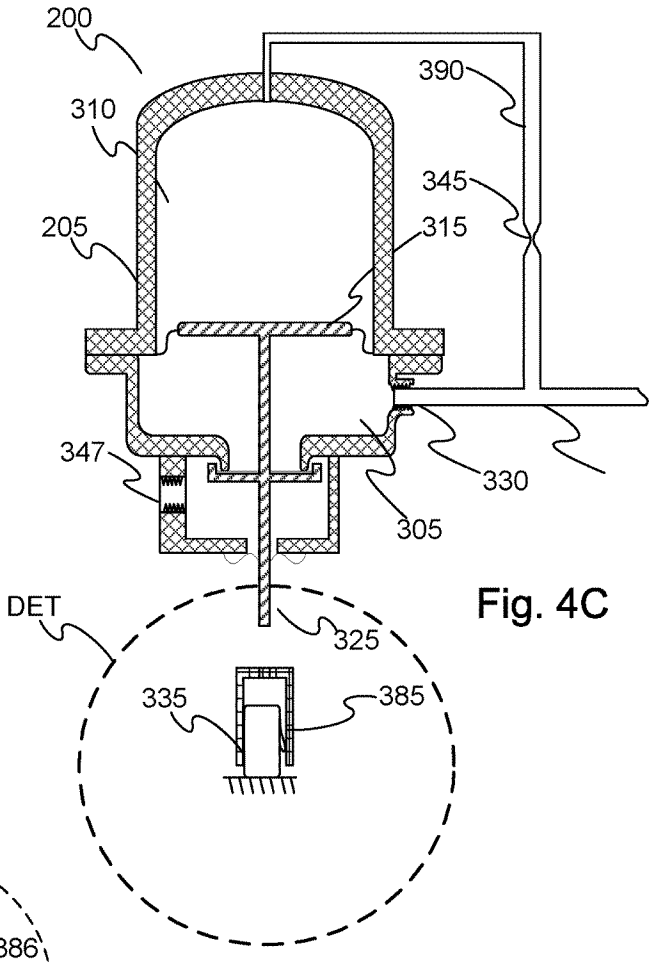

FIG. 4A also depicts an optional switch activation and latching mechanism. When the pressure sensing member moves to the open position it pushes the rod 325, which in turn pushes a switch cap 385 onto a switch, thus activating it. The switch cap may take any desired shape, including a sleeve, a cylinder, a properly dimensioned loop, and the like, dimensioned such that when pushed the rod 325 it would activate the switch 335. The movement of the switch cap may be obstructed by a resilient obstruction 336 such as a spring, a plunger, a handle, and the like, or be dimensioned such that the pushing the cap thereupon requires a certain force, to prevent nuisance tripping. In certain embodiments the obstruction is utilized to activate the switch, while in others a different portion of the switch cap is utilized for that purpose. The force exerted by the rod 325 is sufficient to cause the switch cap to be pushed and activate the switch. Preferably the switch cap would encircle the switch. FIG. 4B depicts the activator at an activated state with the pressure sensing member and the rod pushing the switch cap onto the switch, compressing the resilient obstruction 336 and activating the switch.

Latching of the switch may be achieved by allowing the switch cap 385 to disengage from the rod 325. Therefore the switch cap would remain holding the switch engaged after it was pushed thereon by the rod. FIG. 4C depicts the activator after the rod and the pressure sensing member have been retracted from the switch cap, which remains coupled to the switch and maintaining the switch activated.

The switch arrangement may take various arrangements. By way of example the switch cap may be a magnet disposed so as to be pushed into a sensor, and optionally stay within the range of the sensor because it is not permanently attached to the rod (Not shown).

FIG. 4C also depicts an optional arrangement for controlling pilot fluid flow between the immediate and delay chambers utilizing an external flow restrictor. In this exemplary embodiment the flow restrictor 345 is disposed externally to the activator body 205, and being in fluid coupling to the pilot line 45 on one side, and via line 390 to the delay chamber. It is noted that the flow restrictor 345 may be coupled directly between the immediate and delay chambers.

Figure 4E:
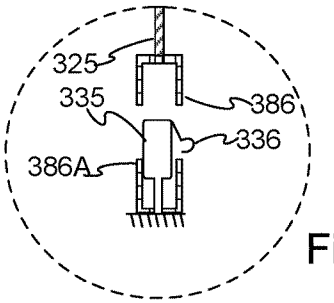
Figure 4B:
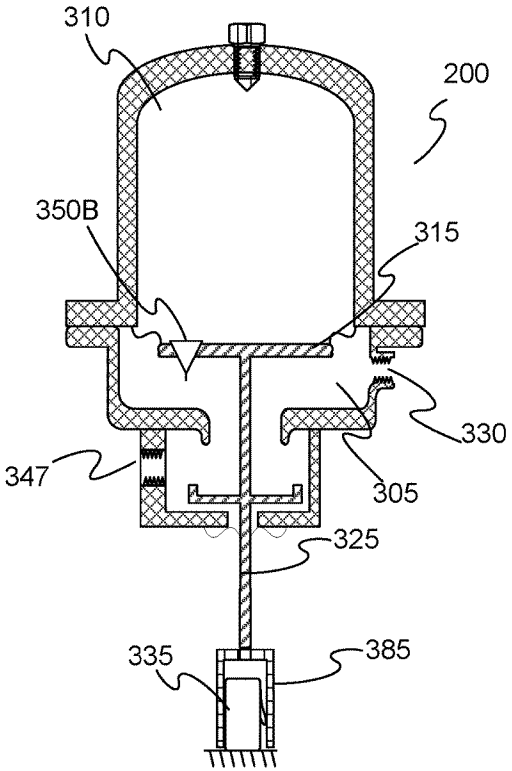
Figure 4D:
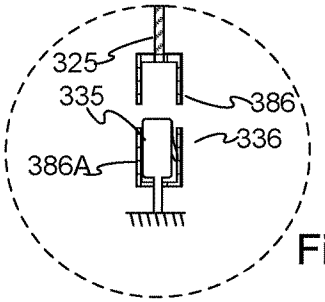

FIGS. 4D and 4E represents the section marked by the segmented circle DET of FIG. 4C, however these figures depict a different example of the latching arrangement than the one shown in other figures. In this embodiment the latch comprises a retainer 386A which during standby state is located about the switch, maintaining it in the standby state, as seen in FIG. 4D. FIG. 4E depicts the latching arrangement after activation of the activator, and with rod being retracted. During activation, the retainer 386A is pushed downwards by pusher 386. Pusher 386 is dimensioned to allow the switch to transition to the active state while the pusher pushes retainer 386A away from maintaining the switch in a non-active state. Such dimensioning may by way of example be achieved by a slot which will allow the switch to be activated. If the activator transitions back to the non-activated state, switch is still activated until the retainer is relocated to maintain the switch in inactive state.

FIG. 5 depicts a simplified schematic of a firefighting system utilizing the present activator. It is noted that large portions of the firefighting system of FIGS. 5 and 6 are similar to the system depicted in FIG. 1, however the system of FIGS. 5 and 6 are improved by the present activator, which makes certain components of the older system redundant. Similar to FIG. 1 primary firefighting fluid is supplied under pressure Pw to a main pipe 2. By way of example such fluid may be from public water supply, a dedicated reservoir, a dedicated firefighting water supply, a gaseous fluid, foam system and the like. The fluid is piped to a shutoff valve 5 which is normally open. A control valve 10 is coupled to the fluid supply downstream from the shutoff valve 5. A fluid distribution system 15 is coupled to the outlet of control valve 10. Fluid under pressure is also supplied to the control chamber 30 of control valve 10, as well as to control line 20, via flow restrictor 25. As explained above it is common to couple fluid from the primary fluid supply to the control chamber 30, however the pressure supplied to the control chamber Pc may come from any desired source. The shutoff valve 5 is commonly required by applicable standards, but may be omitted in certain systems, for example systems which incorporate the shutoff valve in the control valve. In the embodiment depicted in FIG. 5 the distribution system 15 is used as the pilot line system 45, and during standby state pilot pressure is kept by pressure source 50. In such embodiments the pilot line 45 is said to be embedded in the distribution system 15.

Figure 1:
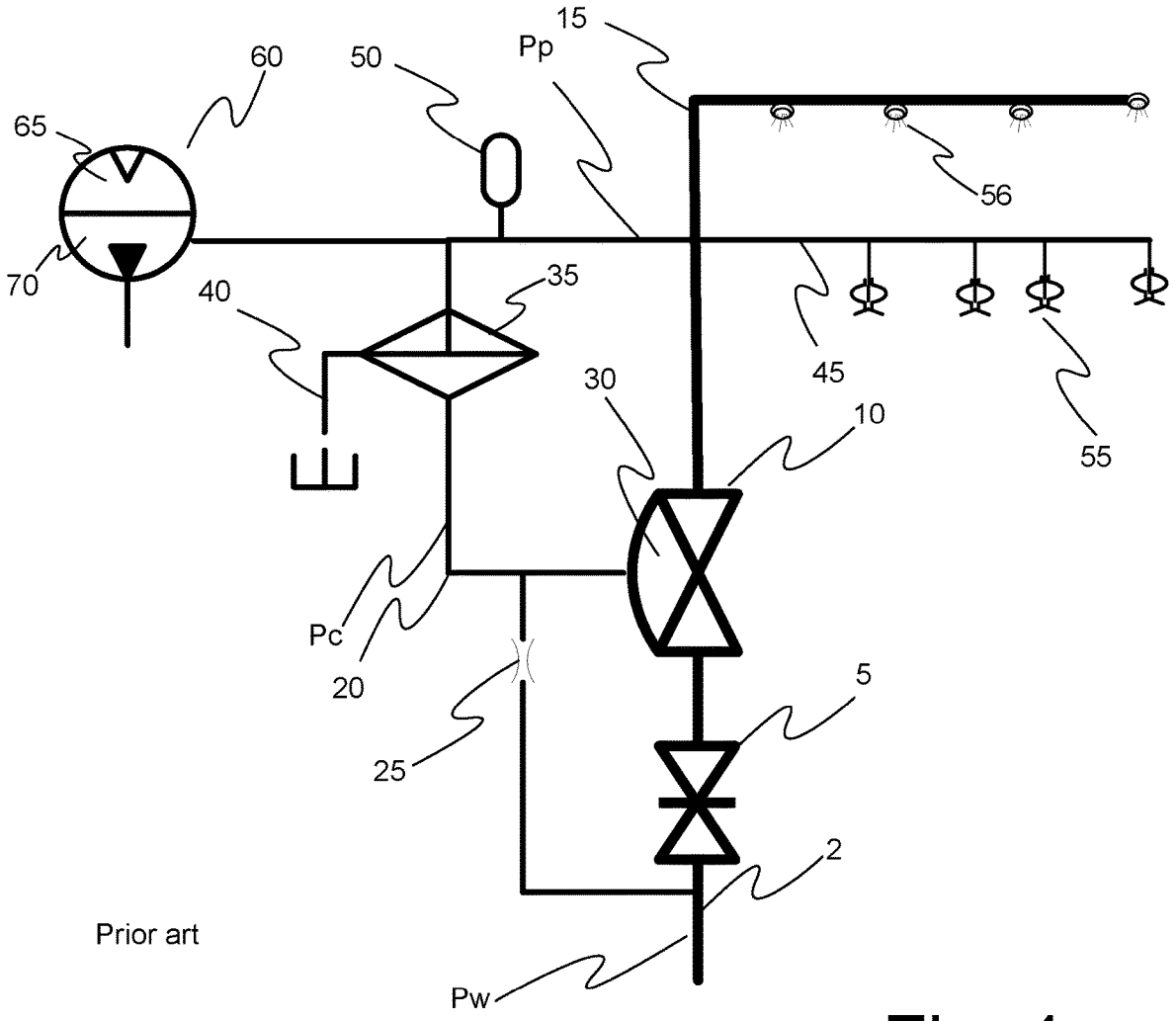
FIG. 1 depicts schematically a common pilot type firefighting system in accordance with the prior art.

The firefighting system depicted in FIGS. 5 and 6 vary from the system of FIG. 1 primarily by the use of activator 200 which replaces both the accelerator 60 and the actuator 35.

Pilot pressure Pp is supplied from the pilot line 45 to the immediate chamber 305 of the activator 200 via the input port 330, and to the delay chamber via the flow restrictor. As explained above, when the sensor 55 activates and vents the pilot pressure to the ambient the pressure in the pilot line 45 is reduced, causing a pressure difference between the immediate and the delay chambers. As a result the pressure sensing moved to the open state, and asserts switch 335. In this simplified diagram a power source 393 is electrically coupled in series to the switch 335 and to a solenoid valve 400. The solenoid valve is coupled in fluid communications to control line 20 and dimensioned to cause a pressure drop in the control line, which in turn reduces the pressure in the control chamber 30 of control valve 10, causing the control valve to open and the firefighting fluid to be piped to the distribution system, and to suppress the fire. An optional alarm 90, represented by dashed lines may also be coupled to the switch 335. The solenoid valve in such embodiment should have lower flow resistance than flow restrictor 25.

The switch may also be utilized to activate an optional alarm 90.

It is important to reiterate that the depicted electrical portion of the system is highly simplified. Electronic devices, processors, relays, controllers and the like (not shown) may be deployed to provide optional system services, increase reliability, and otherwise entertain system and device features and limitations. By way of example electronic control panels are well known in firefighting systems. Such electronic panels, or dedicated logic, may be adapted to provide activation of the solenoid valve 400 as well as generates alarms and notifications as required. Additionally, in certain systems requiring two or more fire indications before the main firefighting fluid is released such panels or logic may be utilized to activate the solenoid valve only when all conditions are met.

FIG. 6 depicts a firefighting system similar to the system of FIG. 5 however it differs therefrom by several optional features. While the firefighting system in FIG. 5 utilizes an integrated pilot and distribution system 45 and 15, the system of FIG. 6 utilizes a primary firefighting fluid distribution system 15 which may utilize sprinklers or open nozzles 56, and a separate pilot line 45 coupled to sensors 55.

Yet another difference is the use of a logic 395 to activate the solenoid valve 400 in response to the activation of the activator switch 335. The logic 395 may activate the solenoid valve only in response to the activation of switch 335 or after a number of conditions have been met, such as after a predetermined delay, after a second detector indicates the presence of fire, and the like. The logic 395 may also activate different alarms 90, send notifications to interested parties such a firefighting personnel or organizations, and the like.

Logic 395 may also act to electrically or electronically latch the switch. Such latching is well known in the electrical arts and be achieved by software, by a flip-flop arrangement, by a relay, by Silicon Controlled Switches (SCR's), triacs, and the like.

Logic 395 may be implemented in numerous ways including inter alia various combinations of general purpose computer or controller, dedicated logic, field programmable logic, discrete gates, transistors, SCR's, and other discrete electronic components, electromechanical relays and the like. The logic may comprise analog and/or logic components. Numerous construction methods and components would be clear to the skilled person coming to implement the logic, once the design requirements are defined.

FIG. 6 further depicts an optional hydraulic latch 398, coupled to the control line 20. The hydraulic latch is operative to prevent pressure buildup in the control chamber 30 once such pressure had been reduced below a certain level. Generally the latch comprise an inlet, and an outlet coupled fluid-wise to a chamber, and a shutoff member which prevents flow from the inlet to the outlet in closed state, and allows such flow when in open state. The shutoff member is urged to an open state by an opening mechanism such as a spring, gravitational pull, and the like. A closing mechanism is also provided, to manually or automatically urge the shutoff member to a closed state. Pressure in the chamber urges the closed shutoff member to remain in the closed state. Thus, in response to pressure in the chamber dropping below a certain level, the shutoff member opens and remains open under the urging of the opening mechanism, until the closing mechanism is activated. In an optional embodiment, the inlet of an hydraulic latch 398 is fluid-wise coupled to the control line 20, and thus, if the pressure in the control line drops below a certain level, the hydraulic latch opens, and will maintain the control line vented, preventing premature closing of the control valve 10.

Numerous specific details are set forth such as examples of specific components, devices, and methods, to provide a thorough understanding of embodiments of the present invention. It will be apparent to those skilled in the art that specific details need not be employed, that example embodiments may be embodied in many different forms and that neither should be construed to limit the scope of the disclosure. By way of example orifice type flow restrictors may be utilized where a check valve type restrictor is depicted, the flow restrictor location may be modified as internal to the activator or external thereto, and the like. Similarly while a passage of those teaching, and/or a drawing may depict a specific combination of latch, switch, pressure sensing member and flow restrictor, each of those components may be replaced by a different type of the component. By way of example an embodiment with a mechanically separable latch and a check valve type restrictor, may utilize an electrical latch in combination with the same check valve restrictor, and the like.

The terminology used herein is for the purpose of describing particular example embodiments only and is not intended to be limiting. As used herein, the singular forms "a," "an," and "the" may be intended to include the plural forms as well, unless the context clearly indicates otherwise. The disclosed embodiments do not preclude additional features, and are intended as illustrative examples, rather than as limiting details. When an element is referred to as being "coupled to" another element, it may be directly on, engaged, connected or coupled to the other element directly or by intervening elements unless the term 'directly coupled' is used, where no intervening elements are present. As used herein, the term "and/or" includes any and all combinations of one or more of the associated listed items. The term 'fluid communication" implies that fluid may flow between the two elements being in such communication, either directly or via a pipe, duct, conduit, valve, and the like, and does not require similar cross-section therebetween. Commonly such communication also exposes the two coupled devices in such communications to similar pressures, especially when the fluid is non-compressible.

Although the terms first, second, third, etc. may be used herein to describe various elements, components, regions, layers and/or sections, such designations are only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed above could be equivalently termed a second element, component, region, layer or section without departing from the teachings of the example embodiments. Spatially relative terms, such as "inner," "outer," "beneath," "below," "lower," "above," "upper," and the like, may be used herein for ease of description to describe one element or feature's relationship to another element(s) or feature(s) as illustrated in the figures, or in or relative to a specified orientation of an embodiment or a portion thereof. Spatially relative terms may be intended to encompass different orientations of the device in use or operation in addition to the orientation depicted in the figures. For example, if a first element is described as being "beneath" other elements or features than the other elements or features would be "above" the first element in the described orientation, but if the device is otherwise oriented the spatially relative descriptors used herein should be interpreted with respect to such orientation. Thus by way of example the term 'upper side' of the pressure sensing member 315 relate to side facing the delay chamber 310, while the 'lower side, relate to opposite side, facing the immediate chamber 305, regardless of the actual orientation of the activator.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

The invention claimed is:

1. An electromechanical firefighting system activator comprising:

a body defining an inner cavity;

a pressure sensing member at least partially disposed within the cavity, the pressure sensing member dividing the cavity into a first and second chambers, at least a portion of the pressure sensing member being movable from a closed to an open state, responsive to pressure difference in the first and second chambers;

a pilot fluid port being in fluid communication with the first chamber;

the first and second chambers having a fluid coupling path therebetween, the fluid coupling path comprising a fluid flow restrictor disposed to control fluid flow from the first chamber and the second chamber, the restrictor has a smaller flow rate from the second chamber to the first chamber, than the flow rate enabled by the pilot fluid port from the first chamber;

a switch actuation mechanism coupled to the pressure sensing member and movable responsive to the state of the pressure sensing member;

a switch disposed to be actuated by the switch actuation mechanism.

2. The electromechanical activator as claimed in in claim 1, wherein the pressure sensing member is urged to an open state when the pressure in the first chamber is lower than the pressure in the second chamber.

3. The electromechanical activator as claimed in claim 1, further comprising a latch configured to directly or indirectly capture and maintain the pressure sensing member in the open state.

4. The electromechanical activator as claimed in claim 1, further comprising a switching latch configured to latch the switch into an activated state, subsequent to being activated by the switch actuation mechanism.

5. The electromechanical activator as claimed in claim 4, wherein the switching latch is selected from a mechanical latch, an electrical latch, an electromechanical latch, an electronic latch, a magnetic latch, and any combination thereof.

6. The electromechanical activator as claimed in claim 4, wherein the switching latch is operationally separable from the switch actuation mechanism.

7. The electromechanical activator as claimed in claim 4, wherein the switch actuating mechanism is configured to move a latch holding the switch in one state during standby state, away from the switch, allowing the switch to move to an activated state.

8. The electromechanical activator as claimed in claim 1, wherein the pressure sensing member is a diaphragm.

9. The electromechanical activator as claimed in claim 1, wherein the switch actuating mechanism comprises a rod coupled to the pressure sensing member.

10. The electromechanical activator as claimed in claim 9, further comprising a latch configured to capture the rod.

11. The electromechanical activator as claimed in claim 1, further comprising a sealing port in fluid communications with the first chamber, and a seal coupled to the pressure sensing member, the seal being operative to impede fluid flow via the sealing port when the pressure sensing member is in a closed state and allow fluid communications via the sealing port when the pressure sensing member is in the open state.

12. The electromechanical activator as claimed in claim 1, wherein the flow restrictor is at least partially disposed within the pressure sensing member.

13. The electromechanical activator as claimed in claim 1, wherein the flow restrictor comprises a check valve configured to allow fluid flow from the first chamber to the second chamber and impede fluid flow from the second chamber to the first chamber.

14. The electromechanical activator as claimed in claim 13, wherein the check valve is constructed to leak, so as to provide unequal fluid flow in each direction between the two chambers.

15. The electromechanical activator as claimed in claim 1, wherein the flow restrictor may be disposed in the body or externally to the body.

* * * * *